US007156339B2

(12) United States Patent
Nicolai

(10) Patent No.: US 7,156,339 B2
(45) Date of Patent: Jan. 2, 2007

(54) APPARATUS AND METHOD FOR WINDING OF WEBS

(75) Inventor: Luc Nicolai, Heinsch (BE)

(73) Assignee: DuPont Teijin Films U.S. Limited Partnership, Wilmington, DE (US)

( * ) Notice: Subject to any disclaimer, the term of this patent is extended or adjusted under 35 U.S.C. 154(b) by 116 days.

(21) Appl. No.: 10/450,988

(22) PCT Filed: Dec. 19, 2001

(86) PCT No.: PCT/EP01/15415

§ 371 (c)(1),
(2), (4) Date: Feb. 23, 2004

(87) PCT Pub. No.: WO02/49946

PCT Pub. Date: Jun. 27, 2002

(65) Prior Publication Data

US 2004/0135025 A1 Jul. 15, 2004

(30) Foreign Application Priority Data

Dec. 20, 2000 (EP) ..... 00311420

(51) Int. Cl.
*B65H 18/26* (2006.01)

(52) U.S. Cl. ..... 242/547; 242/541.4

(58) Field of Classification Search ..... 242/514.4, 242/541.5, 541.6, 541.7, 547
See application file for complete search history.

(56) References Cited

U.S. PATENT DOCUMENTS

| | | | | |
|---|---|---|---|---|
| 1,741,520 | A | 12/1929 | Jagenberg | |
| 2,984,426 | A | 5/1961 | Johnson | |
| 3,670,980 | A | 6/1972 | Mukai et al. | |
| 3,858,821 | A * | 1/1975 | Beard et al. | 242/530.3 |
| 3,871,598 | A * | 3/1975 | Kataoka | 242/413.2 |
| 4,191,341 | A * | 3/1980 | Looser | 242/541.4 |
| 4,415,128 | A * | 11/1983 | Heymanns | 242/541.6 |
| 4,634,069 | A * | 1/1987 | Kataoka | 242/413.5 |
| 5,039,023 | A | 8/1991 | Hagens et al. | |
| 5,251,837 | A * | 10/1993 | Kammann et al. | 242/541.7 |
| 5,584,445 | A * | 12/1996 | Kremar | 242/541.1 |
| 6,527,218 | B1 | 3/2003 | Cramer et al. | |
| 6,854,682 | B1 * | 2/2005 | Nicolai | 242/547 |
| 2003/0234315 | A1 * | 12/2003 | Acciari | 242/541.6 |
| 2004/0238681 | A1 * | 12/2004 | Markkanen et al. | 242/541.1 |

FOREIGN PATENT DOCUMENTS

| | | |
|---|---|---|
| DE | 4343173 A1 | 6/1995 |
| EP | 1047115 | 7/1985 |

(Continued)

OTHER PUBLICATIONS

Chang et al., Air Entrainment with a Forced-Loaded Nip Roller, Article, May 1994, pp. 33-35, WHRC Project 9091-2, Web Handling Research Center, United States.

*Primary Examiner*—Kathy Matecki
*Assistant Examiner*—Sang Kim
(74) *Attorney, Agent, or Firm*—RatnerPrestia

(57) ABSTRACT

The apparatus for winding at lest one web (1), on a winding roll (2), comprises at least a first roll (3), a second roll (4) and a third roll (5) parallel to one another and to said winding roll (2), said apparatus having a nominal winding position in which: a driving torque is applied to at least one of rolls (39, (4) and (5) as to rotate in the direction of said web (1) in order to compensate for the rolling resistance of said apparatus.

23 Claims, 13 Drawing Sheets

FOREIGN PATENT DOCUMENTS

| | | | |
|---|---|---|---|
| EP | 0514226 | A1 | 11/1992 |
| EP | 0670277 | A2 | 9/1995 |
| JP | 07112854 | | 5/1995 |

* cited by examiner

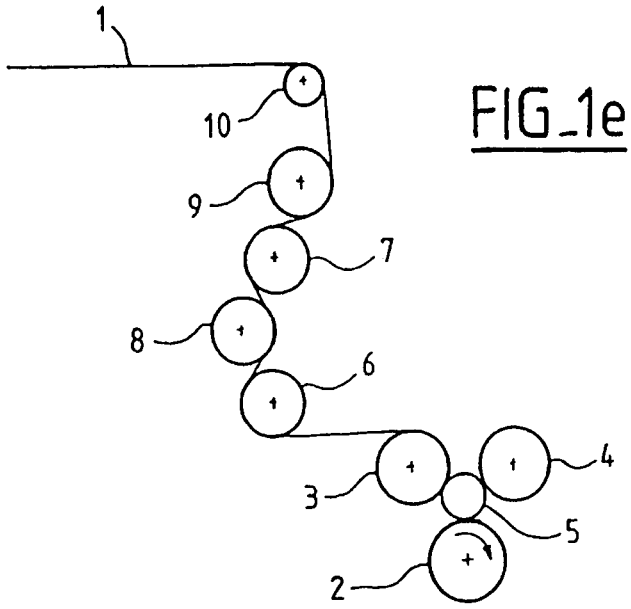
FIG_1e
FIG_2
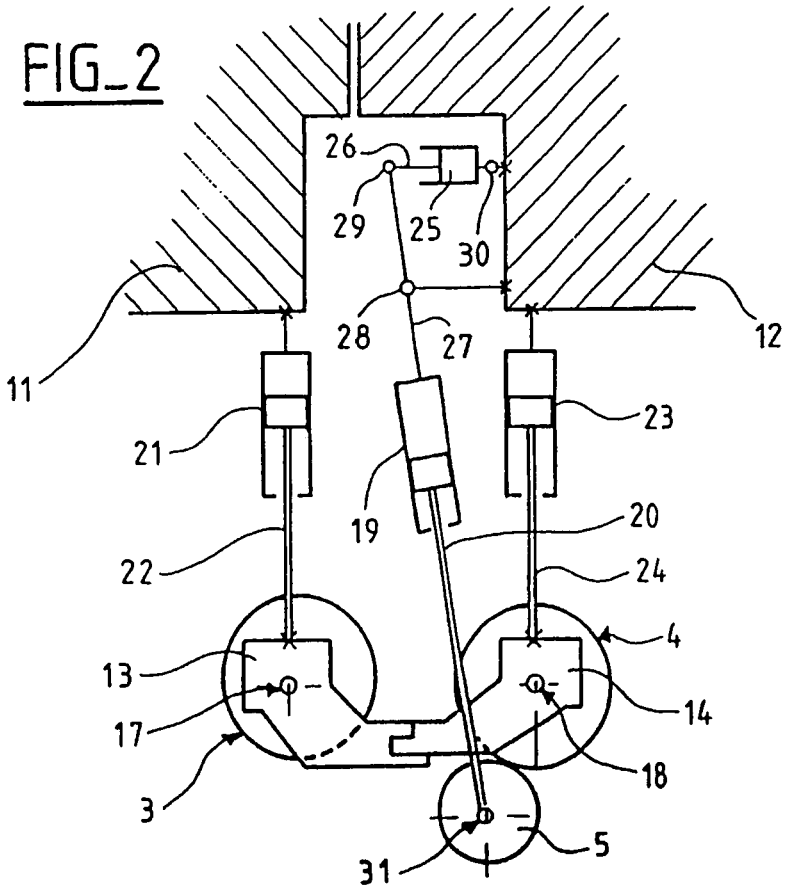

Fig. 13b
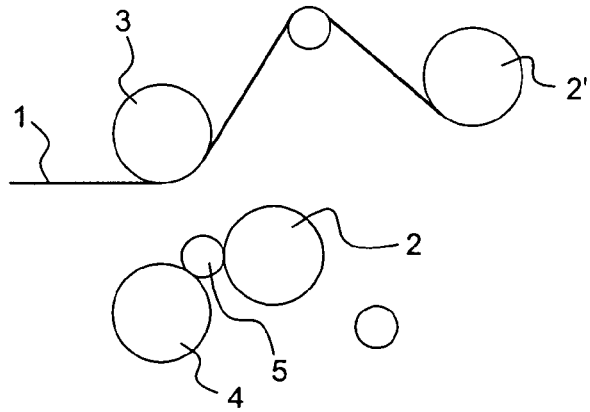
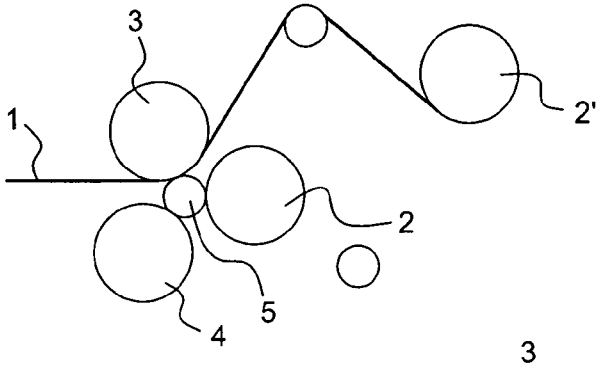
Fig. 13c
Fig. 13d
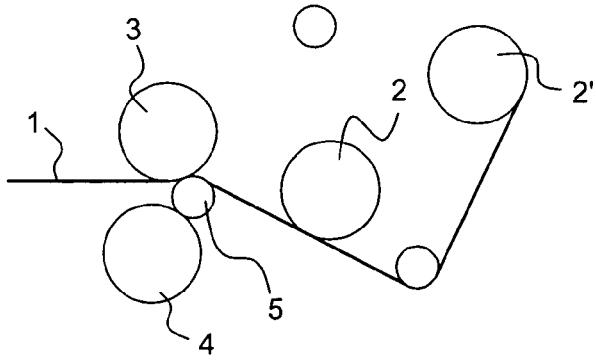
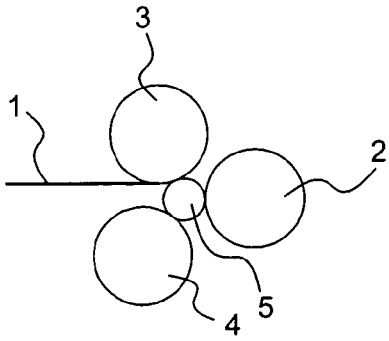
Fig. 13e

APPARATUS AND METHOD FOR WINDING OF WEBS

FIELD OF THE INVENTION

The invention relates to an apparatus and a method for winding of webs.

BACKGROUND OF THE INVENTION

In general, webs such as thin polyester foils or other sheet materials are manufactured in a continuous process and the final products are wound up on rolls for storage and transportation.

During the operation of winding the web on a roll, it is wished to ensure an homogeneous winding on the roll (i.e. without wrinkles or puckers) and to trap as less as possible air between each web layer on the roll.

The problem is particularly acute for (ultra) thin films with thickness as low as the micron size and speeds up to 1000 m/min.

In the prior art, webs, especially in case of thin ones, are usually wound at high velocities (i.e. more than a few hundred meters per minute) with the help of a nip roller (also called packroll) to prevent excessive air entrainment.

In p. 33 to 35 of Air Entrainment with A Forced-Loaded Nip Roller, Y. Bae Chang, F. W. Chambers, J. J. Shelton, Web Handling Research Center, Oklahoma State University, May 1994, it is taught that:

(aa) to keep the amount of air entrainment under a certain level at high speed operation, the most effective way is to reduce the diameter of packroll;

(bb) if the packroll (or its covering) is softer than the winding roll and too much air is entrained, then the problem can be solved by using harder materials for the packroll;

(cc) the amount of entrainment air is not very effectively reduced by increasing the nip loading and if said loading is increased too much, other winding problems can occur.

Furthermore, this document teaches that there may be practical problems or limitations in reducing the size of packrolls, for example, the packroll may become too flexible if it is too thin. However, it suggests to design slender packrolls because of its importance in air entrainment and gives two examples of possible design changes by way of schematic drawings. A first drawing shows a slender roll between a roll and a winding roll, the web passing from the roll to the slender roll and then to the winding roll. A second drawing shows a slender roll between two rolls and a winding roll, the web passing from one of those rolls to the slender roll and then to the winding roll.

However, this document does not give enough hints for to put those principles into practice, i.e. there are several practical problems that are neither solved nor mentioned. A first problem is to ensure the correct position of the slender roll between the roll(s) and the winding roll since the slender roll becomes flexible due to its low diameter. Another problem is to ensure that the tangential speed of the slender roll and of the rolls is identical at each point there between over their length in order to avoid friction on the web. Another problem is to ensure the spreading of the web before winding it on the winding roll, i.e. wrinkles may remain on the web once wound on the winding roll. A further problem is to allow an easy initiation of the winding of the web: the difficulty consists in passing the web between the roll and the slender roll and between the slender roll and the winding roll. Another further problem is to apply a pressure distribution over the width of the winding roll that results in a uniform air exclusion.

The purpose of the present invention is to provide an apparatus and a method for winding webs on winding rolls, which overcome these problems.

SUMMARY OF THE INVENTION

The object of the present invention is to provide an apparatus and a method for winding of webs on winding rolls ensuring a good and uniform air exclusion, no distortion of the web, a good spreading of the web as well as an easy initiation of the winding thereby improving the speed and the quality of the winding.

The object is achieved with an apparatus according to claim 1 and a method according to claim 16. Preferred embodiments are defined in the depending claims.

It is also an object of this invention to provide an apparatus for winding at least one web (1), on a winding roll (2), comprising at least a first roll (3), a second roll (4) and a third roll (5) parallel to one another and to said winding roll (2), said apparatus having a nominal winding position in which:

the first and second rolls(3, 4) and the winding roll (2) are each in contact with the third roll (5);

there is no contact between the first roll (3) and the second roll (4). between the first roll (3) and the winding roll (2) and between the second roll (4) and the winding roll (2);

a first angle defined between a first half-plane delimited by the axis of the third roll (5) and comprising the axis (17) of the first roll (3) and a second half-plane delimited by the axis of the third roll (5) and comprising the axis (18) of the first roll of the second roll (4), is smaller than 180°;

a second angle defined between a third half-plane delimited by the axis of the third roll and comprising the axis of the winding roll and a fourth half-plane delimited by the axis of the third roll and comprising an intersection line is greater than 90°, the intersection line being defined as the intersection between the bisector plane of the first angle and the plane comprising the axis of the first roll and the axis of the second roll; wherein:

the web passes at least between the third roll and the winding roll;

in said nominal winding position, said third half-plane is substantially horizontal; and said third roll auto-centers with respect to said winding, first and second rolls.

BRIEF DESCRIPTION OF THE DRAWINGS

FIGS. 1*a* to 1*e* are schematic side views of the rolls of an apparatus according to the invention, illustrating the operating of said apparatus;

FIG. 2 is a schematic side view showing the mechanical links between the rolls and the carriages;

DETAILED DESCRIPTION OF THE INVENTION

FIGS. 1*a* to 1*e* show the operation of a preferred embodiment of an apparatus according to the invention from the open state allowing the initiation of the winding on the winding roll till the working position for ensuring a winding of high quality for thin webs (down to about a micron for polyester webs) at high speeds (up to 1000 m/min).

Figure 1A:
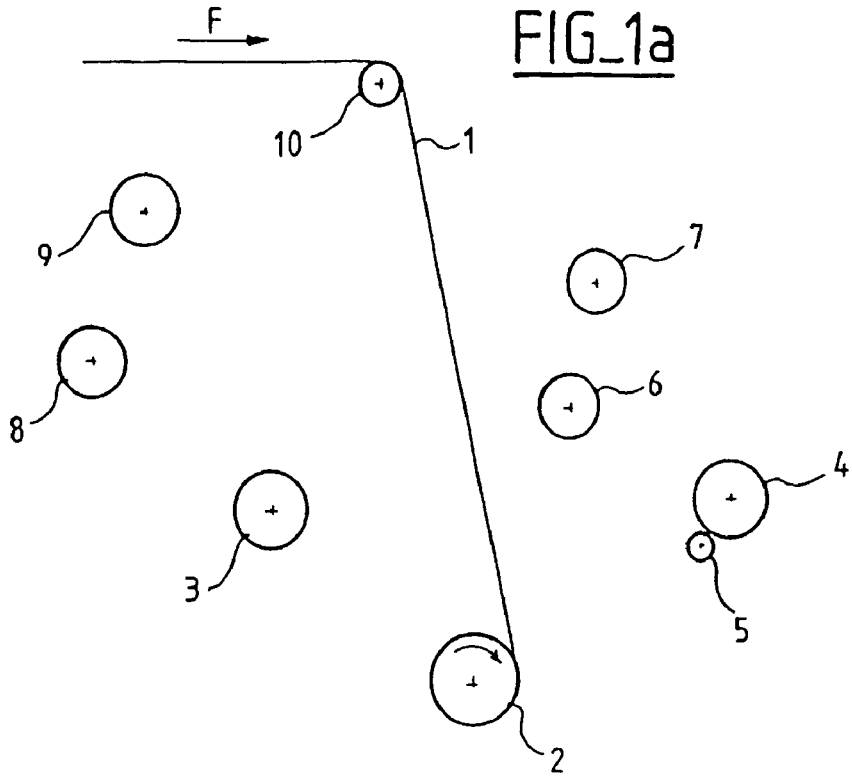

FIG. 1*a* shows an apparatus according to the present invention in open position. A web 1 such as a polyester foil arrives from a conveyance direction indicated by arrow F. As the apparatus is in open position, the web is diverted towards a winding roll 2 (located in a lower position) via, for example, an idle roll 10 (which is fixed). The path between idle roll 10 and winding roll 2 is free in order to allow an easy initiation of the winding of web 1 on winding roll 2, either manually or by automatic means. A first set of rolls (3, 8, 9) is provided on one side of said path. Said first set of rolls is carried by a first movable carriage 11 (not shown). A second set of rolls (4, 5, 6, 7) comprising a slender roll 5, is provided on the side opposite to said first set of rolls with respect to said path. Said second set of rolls is carried by a second movable carriage 12 (not shown).

Figure 1B:
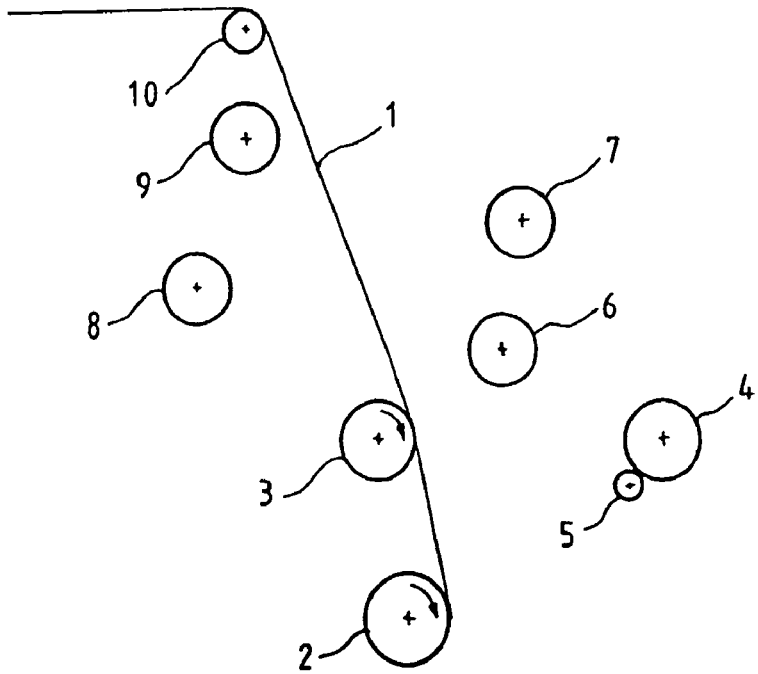

Once the winding of web 1 on winding roll 2 is initiated, first carriage 11 is moved towards the portion of web 1 extending between idle roll 10 and winding roll 2, till a position in which roll 3 abuts web 1. This situation is illustrated in FIG. 1*b*. Before abutting web 1, roll 3 is preferably caused to rotate with a tangential speed and in a direction substantially corresponding to those of the displacement of web 1. Rolls 8 and 9 are shown not abutting web 1, however, it may be the case.

Figure 1C:
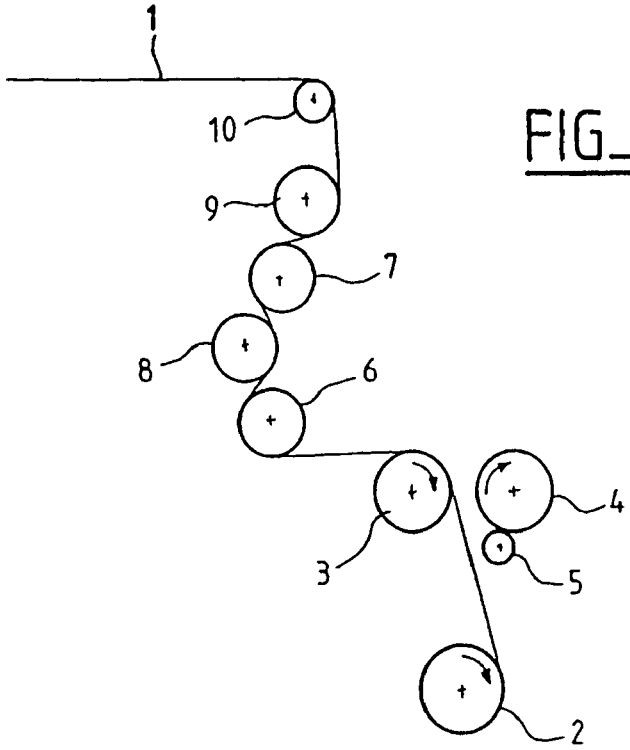

Once at the stage of FIG. 1*b*, second carriage 12 is moved towards web 1 till a defined position in which roll 3 and roll 4 are narrow, but not into contact with each other. This situation is illustrated in FIG. 1*c*. For sparing operating time, this step (i.e. moving second carriage 12 towards web 1) may be realized simultaneously with the previous one consisting in the displacement of carriage 11 towards web 1. The simultaneous displacement of first carriage 11 and second carriage 12 is indeed preferred. In the position of FIG. 1*c*, slender roll 5 is preferably located under roll 4 slightly towards roll 3, i.e. slender roll 5 abuts roll 4 but does not abut roll 3. Neither roll 4 nor slender roll 5 abut web 1. Rolls 8 and 9 of the first carriage 11 and rolls 6 and 7 of the second carriage 12 are located so as to form a jaw having been closed on the web. More precisely, roll 7 of the second carriage 12 is located substantially between roll 8 and roll 9 of the first carriage 11, and preferably in a narrow fashion but without being into contact with them. Roll 6 of the second carriage 12 is substantially located under roll 8 of the first carriage 11 and preferably close to the latter. Thus, web 1 is caused to abut roll 9 and to pass from roll 9 on roll 7, from roll 7 on roll 8, from roll 8 to roll 6 so as to form waves. The jaw defined by rolls 6, 7, 8 and 9, when closed onto web 1, isolates the winding tension from the incoming tension, which might be too low or too high. It is possible to vary the number of rolls forming said jaw. Further, before abutting web 1, rolls 6, 7, 8 and 9 are preferably caused to rotate each with a tangential speed and in a direction corresponding to that of web 1 (so as to avoid friction between said rolls and web 1); so, excessive tension on web 1 at the moment of being abutted by said rolls (which could arise if said rolls were idle rolls) are avoided. For web 1 having a width up to 2 meters and being conveyed at a speed up to 1000 meters/min, it is advantageous for rolls 6, 7, 8 and 9 having a diameter of about 120 millimeters. Preferably, roll 6 is horizontally spaced from roll 3 so that web 1 passes from roll 6 to roll 3 in a substantially horizontal fashion. Furthermore, roll 3 and roll 4 are preferably interlocked in this position in order to avoid relative change of position between them as it will be described in relation with FIG. 3.

Once at the stage of FIG. 1*c*, roll 4 is preferably caused to rotate with a tangential speed corresponding to the speed of web 1 and in the same direction than roll 3. As a result, roll 4 causes slender roll 5 to rotate by friction driving because slender roll 5 abuts roll 4. Slender roll 5 is then moved upwards along the circumference of roll 4 until it abuts roll 3 through web 1. Hence, slender roll 5 is in abutment both with roll 3 (through web 1) and roll 4, and, as a consequence, slender roll 5 is precisely positioned by those rolls 3 and 4. Web 1 passes now from roll 3 to slender roll 5 and then to winding roll 2. The axis of slender roll 5 and the axis of winding roll 2 are preferably contained in a substantially vertical plane. This situation is illustrated in FIG. 1*d*.

Figure 1D:
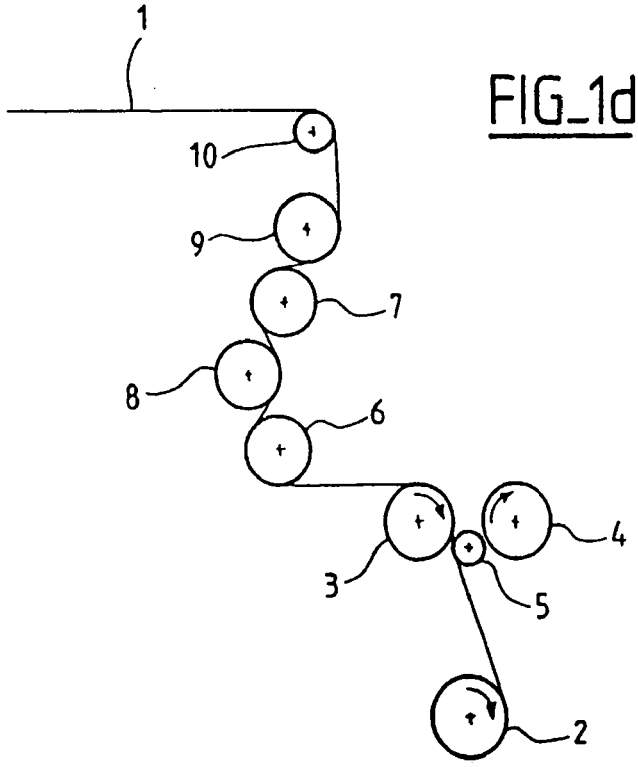
Figure 1F:
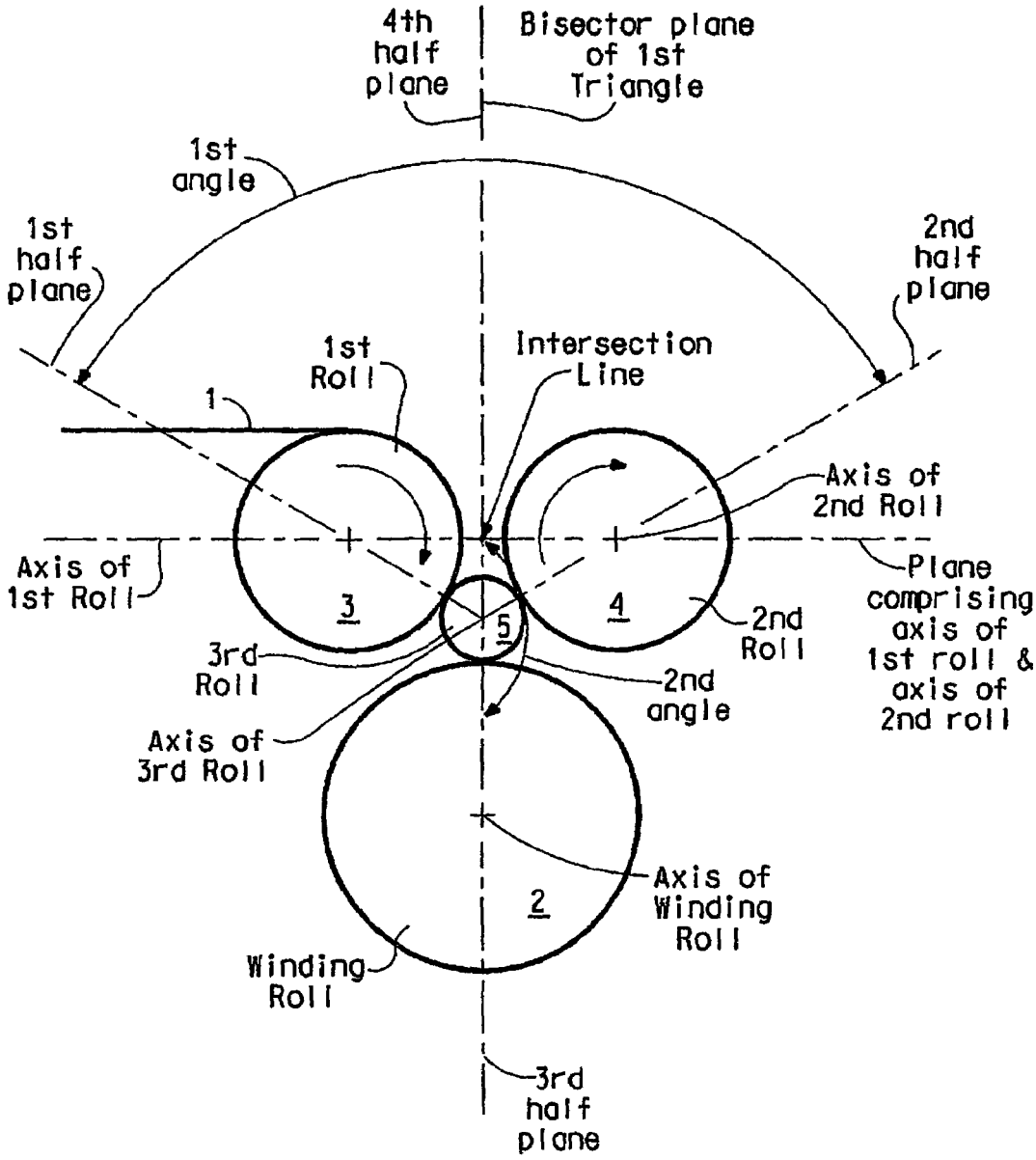
FIG. 1*f* illustrates the angles, planes and intersection lines regarding the apparatus of figures 1*a* to 1*e*.

Once at the stage of FIG. 1*d*, the block formed by carriages 11 and 12 is lowered (i.e. the whole roll assembly) till slender roll 5 abuts winding roll 2, preferably at its top. This situation is illustrated in FIG. 1*e*. As it can be taken from FIG. 1*e*, rolls 3 and 4 do not abut winding roll 2. This lowering may be achieved e.g. by a main carriage (not shown) movable vertically, on which carriages 11 and 12 are slidably mounted in the horizontal direction (to allow their displacement towards web 1 mentioned in relation with FIG. 1*a* to FIG. 1*c*). Just before slender roll 5 abuts winding roll 2, preferably at a distance of about 10 millimeters, the driving in rotation of rolls 3 and 4 is preferably stopped so as to act now as idle rolls; this may be classically achieved by disengagement of a clutch mechanism. When the apparatus is in position of FIG. 1*e*, it is in nominal position for winding efficiently web 1 on winding roll 2 and slender roll 5 acts as a nip roller.

During each of these steps from FIG. 1*a* to FIG. 1*e*, the rotation speed of winding roll 2 is preferably varied so as to keep a substantially constant tension of web 1 as the length of the path of web 1 varies during the deviation of web 1 by the various rolls of the apparatus. For instance, this may be achieved by controlling the rotation speed of winding roll 2 as a function of the force exerted by web 1 on roll 6, during the steps described in relation with FIGS. 1*c*, 1*d* and 1*e*.

Referring now to FIG. 2, we will now describe the mechanism for ensuring the correct positioning of slender roll 5 between rolls 3 and 4, FIG. 2 shows only a part of the apparatus relatively to rolls 3 and 4 and slender roll 5 when the apparatus is in the position of FIG. 1*c*. Slender roll 5 (its axis is referenced 31) is held on each end through a corresponding double acting pressure cylinder 19. More precisely, each end of slender roll 5 is articulated on the end of the rod 20 of a respective pressure cylinder 19. Pressure cylinders 19 preferably extend substantially vertically with their rods 20 extending downwards. Each pressure cylinder 19 is preferably fixed on the end of a respective arm 27, which is linked to carnage 12 via a respective pivot link 28. Pivot links 28 are preferably arranged in the middle region of arms 30 27. The opposed end of each arm 27 is linked on the rod 26 of a respective pressure cylinder 25 via a pivot link 29. Pressure cylinders 25 are both linked on carriage 12 via respective pivot links 30. Pressure cylinders 25 preferably extend substantially horizontally. This construction allows to change the horizontal and vertical position of slender roll 5 by controlling pressure cylinders 19 and 25. Thus, when passing from the position of FIG. 1*b* to the position of FIG. 1*c*, slender roll 5 is positioned correctly under roll 4, i.e. without slender roll 5 abutting web 1, by causing rods 20 and 26 of pressure cylinders 19 and 25 to the extended position. Then, to pass from the position of FIG. 1*c* to the position of FIG. 1*d*, rods 20 are caused to retract and thus slender roll 5, runs along the circumference of roll 4 until it abuts also roll 3 through web 1; during this operation, pressure in pressure cylinders 25 is controlled in known manner in order to maintain slender roll 5 in abutment on roll 4 without excessive strength. Preferably, once slender roll 5 abuts roll 3, no pressure is anymore applied 5 to pressure cylinder 25 so that slender roll 5 is positioned only by rolls 3 and 4 through the pulling forces of pressure cylinders 19.

During winding, i.e. in the position of FIG. 1*e*, pressure cylinders 19 remain retracted to keep both ends of slender roll 5 in abutment with rolls 3 and 4 regardless of the width of winding roll 2.

As regards rolls 3 and 4, they are both rotatably mounted on respective supports 13 and 14, their axis being referenced 17 and 18. Supports 13 and 14 cooperate so as to define an interlocking mechanism for interlocking roll 3 with roll 4 as already mentioned: this will be described more precisely in relation with FIG. 3. Supports 13 are slidably mounted in the vertical direction on carriage 11 (the guiding means are not shown) and are vertically positioned through e.g. double acting pressure cylinders 21. Similarly, supports 14 are slidably mounted in the vertical direction on carriage 12 (the guiding means are not shown) and are vertically positioned through e.g. pressure cylinders 23. So, pressure cylinders 21 and 23 extend parallel and vertically with their respective rods 22 and 24 extending downwards. Pressure cylinders 19, 21 and 23 automatically take up the diameter increase of winding roll 2. However, they are only used for to lilt rolls 3 and 4 and slender roll 5 over a defined detected distance corresponding to e.g. a few millimeters. After that, it is the whole block formed of carriages 11 and 12 which is lift over said defined height and blocked in this new position while pressure cylinders 19,21 and 23 maintain rolls 3 and 4 in abutment with slender roll 5 and slender roll 5 in abutment with winding roll 2. From there on, pressure cylinders 19, 21 and 23 again take up the diameter variation of winding roll 2 until being retracted again from said defined distance after what the whole block is again lifted and so on.

Figure 3:
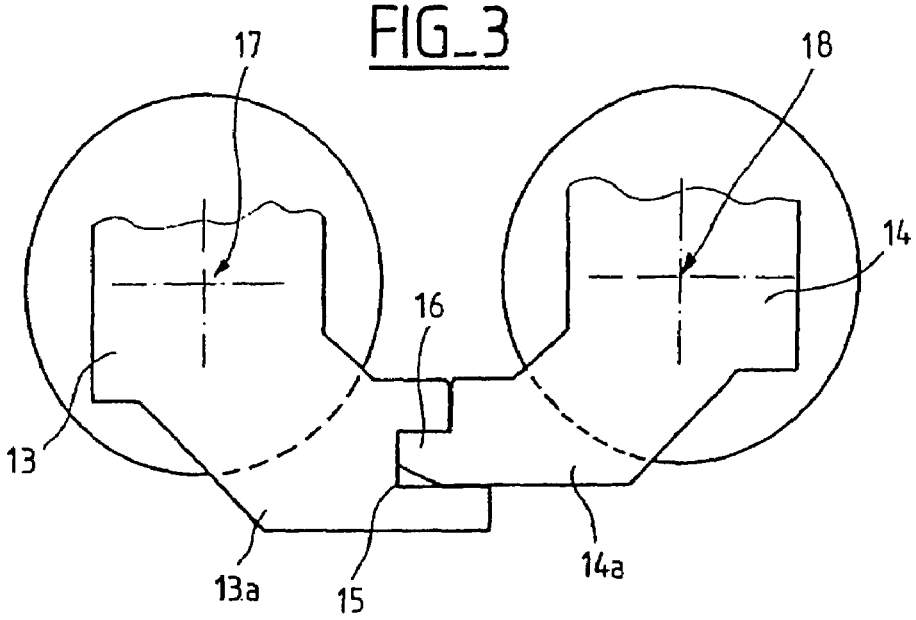
FIG. 3 is a schematic side view of the lower parts of the supports, which interlock.

Referring to FIG. 3, we will now describe the interlocking mechanism of roll 3 with roll 4, which is active in the state of the apparatus shown in FIG. 1*c* to 1*e*. FIG. 3 is a schematic side view showing the lower part of support 13 carrying roll 3 (its axis being referenced 17) and the lower part of support 14 carrying roll 4 (its axis being referenced 18). The lower part of support 13 exhibits an arm 13*a* extending laterally towards support 14. A groove 15 is arranged at the free end of arm 13*a*. The lower part of support 14 exhibits an arm 14*a* extending laterally towards support 13. A nose 16 is arranged on the free end of arm 14*a*. The shape of the free end of arm 14*a* matches the shape of the free end of arm 13*a* and, more particularly, nose 16 fits groove 15. Nose 16 has preferably a beveled edge to facilitate the engagement with groove 15. Thus, when the apparatus comes to the position of FIG. 1*c*, support 13 and support 14 interlock. Furthermore, both supports 13 and 14 are maintained interlocked e.g. by way of means acting on carriages 11 and 12 so as to avoid lateral disengagement from one another. In this way, both supports 13 and 14 form one rigid block horizontal or vertical relative vibrations between support 11 and support 12 are eliminated.

We will now describe the relationship between rolls 3 and 4, slender roll 5 and winding roll 2 from the mechanical point of view. When the apparatus is in the position of FIG. 1*e*, i.e. the nominal position for winding efficiently, slender roll 5 acts as a nip roller. The diameter of slender roll 5 is preferably as small as possible in order to minimize the air entrainment between web 1 and winding roll 2. Thus, slender roll 5 becomes flexible over its length and, in the absence of rolls 3 and 4, may bend and vibrate on winding roll 2 while winding. Resonance may even occur. Both, the bending and vibrating of slender roll 5 would adversely result in tangential speed differences between slender roll 5 and winding roll 2 inducing friction on web 1, variations of tension in web 1 and bad effects as regard the spreading of web 1 as well as regards the air entrainment. Thus, it is preferred to avoid the bending and vibrating of slender roll 5 while winding. For that purpose, rolls 3 and 4 flank slender roll 5 on its upper half circumference so as to sandwich it between them and winding roll 2 while winding. Further, rolls 3 and 4 are preferably more rigid than slender roll 5 in order to be able to support slender roll 5: that is preferably obtained with rolls 3 and 4 having a greater diameter than slender roll 5. Rolls 3 and 4 preferably have each a diameter being one to six times, preferably three times, the diameter of slender roll 5. Preferably, rolls 3 and 4 have the same diameter and are positioned at the same vertical level. Further, the surface of roll 3, which is wrapped by web 1 (in this embodiment), is advantageously smooth; preferably, its surface is metallic and polished, its roughness Rt (i.e. the difference between the highest and lowest point of the surface) being lower or equal to 25 μm. In that case, web 1 floats on the aerodynamic boundary layer without contacting the surface of roll 3. This results in a spreading effect. Similarly, the surface of roll 4 is advantageously smooth similarly to roll 3. Slender roll 5 consists preferably in a core with an elastic coating, which conforms itself to the surface of winding roll 2. For slender roll 5 having a width up to 2 meters and web 1 being conveyed at a speed up to 1000 meters/min, it is advantageous for slender roll 5 having a diameter of about 50 millimeters and for rolls 3 and 4 having a diameter of about 150 millimeters each. Thus, rolls 3 and 4 allow to position precisely slender roll 5 between them and, as a consequence, slender roll 5 is correctly positioned on winding roll 2 and further, rolls 3 and 4 provide dynamic stability while winding.

The distance between slender roll 5 and winding roll 2 in FIG. 1*d* is preferably small so that the time needed to pass from the position of FIG. 1*d* to the position of FIG. 1*e* is low, and thus, it limits the time during which slender roll 5 may possibly bend or vibrate under rolls 3 and 4 as it is not in abutment with winding roll 2 yet. The mechanism for ensuring the correct positioning of slender roll 5 between rolls 3 and 4 will be more precisely described in relation with FIG. 3.

Since supports 13 and 14 are preferably interlocked when arriving in position of FIG. 1*c* as already mentioned and remain interlocked in the subsequent steps (corresponding to FIGS. 1*d* and 1*e*), relative movement, more particularly vibrations, between rolls 3 and 4 are avoided while winding and thus, it avoids unwished bending and vibrations of slender roll 5 that may be induced by said relative movement or vibrations between rolls 3 and 4.

Further, the apparatus is designed so as to avoid, when in position of FIG. 1*e*, lateral movement, more particularly lateral vibrations, of the block formed by carriages 11 and 12 with their supports 13 and 14 being interlocked, and thus of rolls 3 and 4 and slender roll 5, relatively to winding roll 2. However, the vertical position of the unit formed by rolls 3 and 4 and slender roll 5 adapts to the diameter of winding roll 2 while increasing during the winding as it was described in relation with FIG. 2. Pressure cylinders 21 and 23 are preferably of pneumatic type in order to define an adjustable contact pressure between winding roll 2 and slender roll 5 and to absorb the eventual vertical vibrations. Pressure cylinders 19 are also preferably of the pneumatic type. As already mentioned, web 1 preferably passes substantially horizontally from roll 6 to roll 3 so that eventually remaining vertical movements or vibrations of roll 3 and slender roll 5 (due to the run out of winding roll 2) do not cause substantial variation of tension in web 1 as it would be the case if web 1 is fed vertically to roll 3.

In the position of FIG. 1*e*, efforts relative to slender roll 5 are distributed as follows.

The weight W of rolls 3 and 4 (which are interlocked) is supported by winding roll 2 via slender roll 5. Roll 3 and roll 4 have preferably the same weight. However, at least a small amount $\Delta W$ of their weight W is preferably supported by pressure cylinders 21 and 23 disposed at each end of said rolls 3 and 4, said pressure cylinders pulling upwards half of that amount, i.e. $\Delta W/2$, at each end. Preferably, amounts $\Delta W$ are selected so as to be sufficient for obtaining that the pressure exerted by slender roll 5 on winding roll 2 is maximal in the middle of slender roll 5 and decreases progressively towards its edges. Nevertheless, the pulling forces $\Delta W/2$ of pressure cylinders 21 and 23 are limited so that slender roll 5 remain in abutment with winding roll 2 over the whole width of web 1. As a consequence, the efficiency of slender roll 5 for diminishing the air entrainment between web 1 and winding roll 2 is further improved as it favors the expulsion of the air caught between web 1 and winding roll 2 from the middle towards the edges of web 1 in the abutment region of slender roll 5 with winding roll 2. In practice, the pulling upward force of $\Delta W/2$ developed by pressure cylinders 21 and 23 on each end are preferably obtained by feeding pressure cylinders 21 and 23 of a differential type (at each end) with a first pressure (a) inducing an upward constant force of W/2 and with a second pressure (b) inducing a downward force of $(W/2-\Delta W/2)$: thus, the resultant force on each end of rolls 3 and 4 is $\Delta W/2$ directed upwards.

As regards the abutment of slender roll 5 on rolls 3 and 4, the reaction forces of slender roll 5 on rolls 3 and 4 due to at least a part of the weight of rolls 3 and 4 supported by winding roll 2 via slender roll 5 are preferably maintained as low as possible, rolls 3 and 4 just avoiding the bending and vibrating of slender roll 5 as well as ensuring its correct positioning. Thus, compression of web 1 between slender roll 5 and roll 3 is maintained low and, as a result, avoids to harm web 1. From that point of view, the angle between the half-plane delimited by the axis of slender roll 5 and comprising the axis of roll 3 and the half-plane delimited by the axis of slender roll 5 and comprising the axis of roll 4 is preferably as low as possible, e.g. 130°. As a result, the efforts of slender roll 5 on rolls 3 and 4 are minimized for a given effort exerted from winding roll 2 on slender roll 5 if relevant.

In practice, winding roll 2 bows slightly downward due to its own weight and due to the fact it is supported on its ends. However, if designed properly, winding roll 2 is more rigid than slender roll 5 and than rolls 3 and 4, and consequently, winding roll 2 bows less downward than might do slender roll 5 and rolls 3 and 4. So, in fact, rolls 3 and 4 and slender roll 5 bow of the same amount than winding roll 2 which continue to support slender roll 5 at least over the width of web 1 as previously described. However, it is preferred that pressure cylinders 19 develop an upward force at each end of slender roll 5 sufficient for ensuring that both end regions of slender roll 5 abut rolls 3 and 4 for any width of winding roll 2.

It is preferred that slender roll 5 abuts the top of winding roll 2 as shown in FIG. 1*e* (or, in another embodiment, that winding roll 2 abuts the top of slender roll 5). Thus, the tangential speed of winding roll 2 and slender roll 5 as well as the tangential speed of slender roll 5 and roll 3 are substantially identical for each point on the width of web 1, and so no frictions on web 1 are generated. This is not obtained if slender roll 5 abuts laterally winding roll 2, (thus, rolls 3 and 4 flank slender roll 5 laterally). Indeed, rolls 3 and 4 bow each downward of substantially a same fixed amount (if they are identically designed) and winding roll 2 bows downward with another amount which furthermore varies as its diameter increases due to web 1 wound on it. As a consequence, rolls 3 and 4 do not position correctly slender roll 5 on winding roll 2 over its whole length and it results in differences of tangential speed vectors between roll 3 and slender roll 5 and between slender roll 5 and winding roll 2, thus inducing friction on web 1. Further, slender roll 5 may even slightly vibrate as slender roll 5 is no more correctly sandwiched on all its length between rolls 3 and 4 on one hand and winding roll 2 on the other hand.

Figure 4:
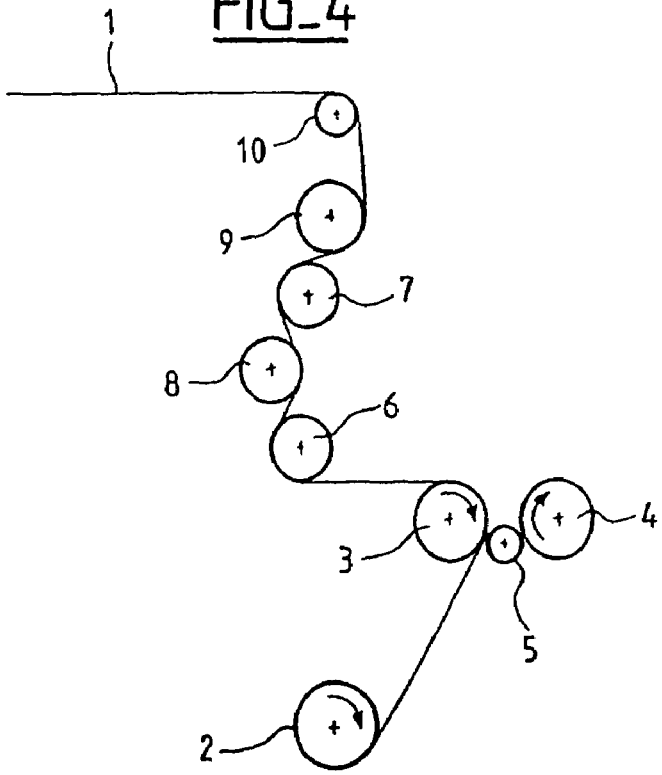
FIG. 4 is a schematic side view for an alternative embodiment of the invention.

In another preferred embodiment, it is proposed the same apparatus than the one described up to now, but with modified steps compared to those of FIG. 1*a* to FIG. 1*e*. Initial position of the apparatus is the one of FIG. 1*a*. Displacement of first carriage 11 and second carriage 12 are similarly executed than described previously for passing from FIG. 1*a* to FIG. 1C, but lateral displacement distances are modified so that the apparatus reaches the state of FIG. 4 instead of the one of FIG. 1*c*. Then, slender roll 5 is moved along roll 4 until it contacts roll 3, as previously described for passing from FIG. 1*c* to FIG. 1*d*. Then, the block formed by first carriage 11 and second carriage 12 (with their supports 13 and 14 being interlocked as previously) is laterally shifted in order to go in the position of FIG. 1*d* and then, to the position of FIG. 1*e*.

Figure 5:
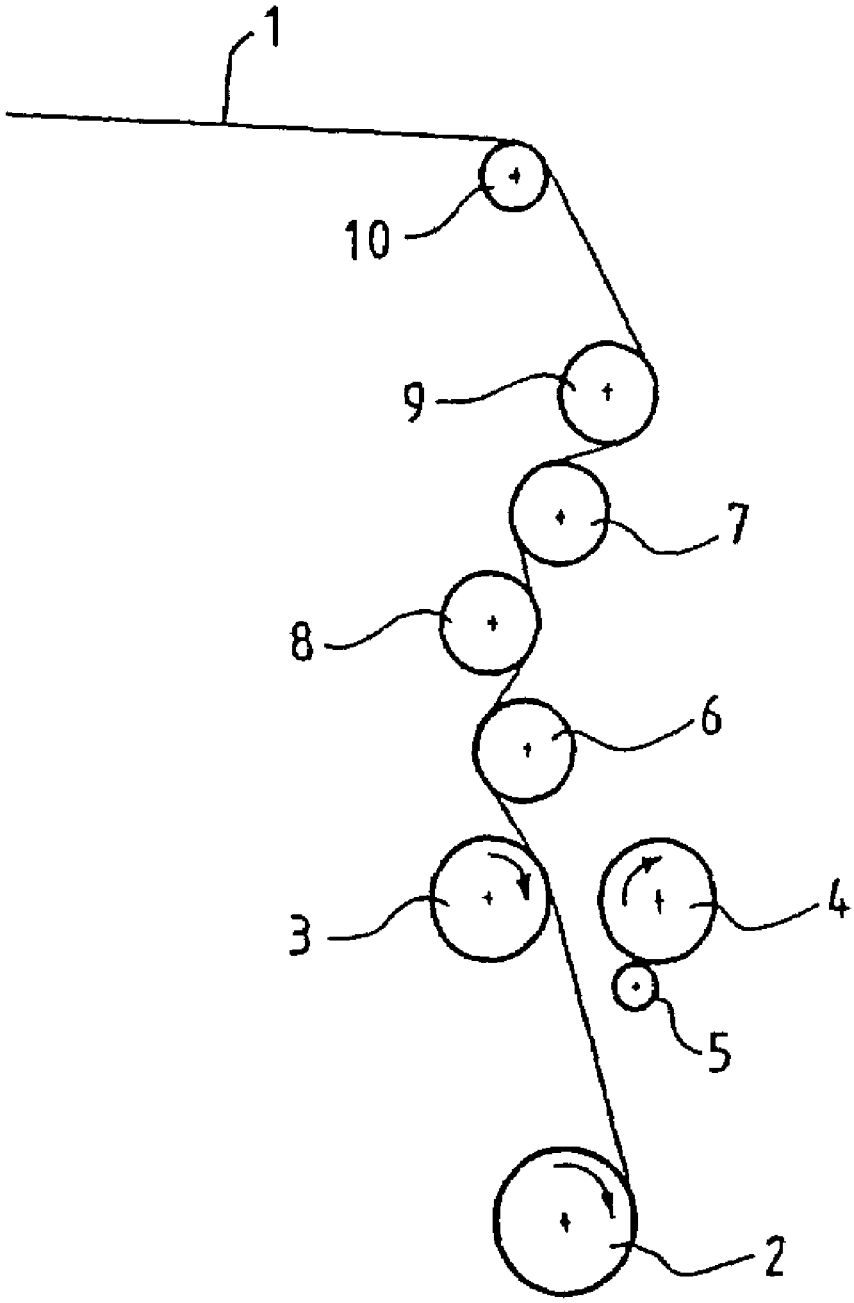
FIG. 5 is a schematic side view for another alternative embodiment of the invention.

In a further preferred embodiment, it is proposed a similar apparatus, which allows to gain space following the horizontal direction. In the embodiment shown in relation with FIG. 1*a* to 1*e*, 3 is laterally shifted with respect to rolls 8 and 9 which are shown substantially vertically aligned. Similarly, roll 4 and slender roll 5 are laterally shifted with respect to rolls 6 and 7 which are also shown substantially aligned. Thus, when the apparatus is in open state as in FIG. 1*a*, it takes some place in the horizontal direction. It is for example possible to mount roll 3 on one carriage and rolls 8 and 9 on a further carriage, both being movable laterally. Similarly, roll 4 and slender roll 5 may be mounted on one carriage while rolls 6 and 7 are mounted on a further carriage, both being movable laterally. Thus, when the apparatus is in open condition as illustrated in the previous embodiment by FIG. 1*a*, it is possible to align approximately vertically rolls 3, 8 and 9 on one side of the path of web 1 between idle roll 10 and winding roll 2 and it is possible to align approximately vertically rolls 4, 6 and 7 on the other side of said path. Thus, it is possible to spare the horizontal distance previously separating rolls 8 and 9 from roll 3 and the horizontal distance separating roll 4 and slender roll 5 from rolls 6 and 7. Then, both carriages carrying roll 3 and rolls 8 and 9 may be simultaneously moved, toward web 1 to abut it and then (or eventually simultaneously) both carriages carrying roll 4, slender roll 5 and rolls 8 and 9 may be simultaneously moved toward web 1 until that rolls 3 and 4 and slender roll 5 are in the position previously illustrated in FIG. 1*c*, At this stage, rolls 8 and 9 and rolls 6 and 7 form the previously mentioned jaw closed on web 1, but said jaw is then substantially vertically aligned with rolls 3 and 4 and slender roll 5 as shown in FIG. 5. Roll 6 is slightly above rolls 3 and 4 as regards the vertical position. From this position on, the carriage of rolls 8 and 9 and the carriage of rolls 6 and 7 are simultaneously shifted in the horizontal direction to get to the position depicted in FIG. 1*c* and then the subsequent steps of the previous embodiment are normally carried out. However, before operating said shift, it is possible to realize previously the step described for passing from the previous position of the apparatus described in FIG. 1*c* to the position of FIG. 1*d* in the embodiment.

In the different embodiments described previously, when the apparatus is in the nominal winding position (i.e. position shown in FIG. 1*e*), web 1 passes between roll 3 and slender roll 5 and then between slender roll 5 and winding roll 2. Alternately, it is possible to thread up web 1 through a different path in the device comprising rolls 3 and 4 and slender roll 5 for winding web 1 on winding roll 2.

Figure 6A:
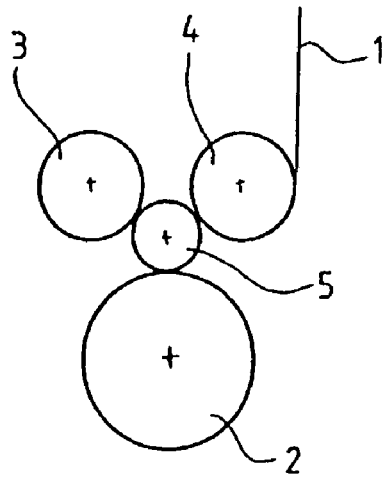
FIGS. 6*a* and 6*b* show alternative possibilities to thread up the web through the rolls of an apparatus according to the invention.

For instance, as shown in FIG. 6*a*, web 1 may first pass between roll 4 and slender roll 5, then between roll 3 and slender roll 5 and finally between slender roll 5 and winding roll 2. In this case, the apparatus has preferably an open position in which slender roll 5 is located on one side of the path of web 1 in course of winding on winding roll 2 and rolls 3 and 4 are located on the other side of the path of web 1 in course of winding on winding roll 2. Then, when the apparatus is caused to its nominal winding position (e.g. by moving rolls 3 and 4 and slender roll 5 towards winding roll 2 the location of which may be fixed, or by moving slender roll 5 and winding roll 2 towards rolls 3 and 4 the location of which may be fixed), web 1 will be accordingly threaded up.

Figure 6B:
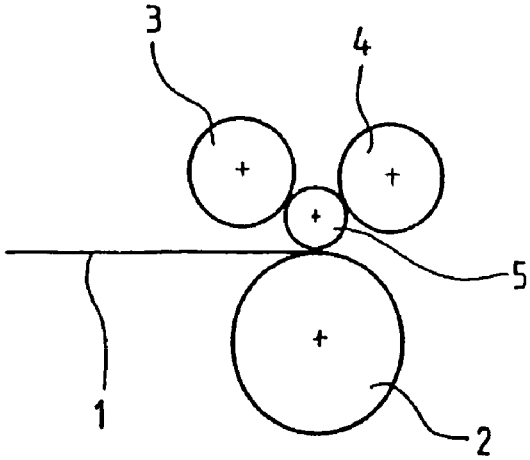

As shown in FIG. 6*b*, web 1 may also directly pass between slender roll 5 and winding roll 2, without passing between roll 3 and slender roll 5 or between roll 4 and slender roll 5. In this case, the apparatus has preferably an open position in which rolls 3 and 4 and slender roll 5 are all located on a same side of the path of web 1 in course of winding on winding roll 2. Further, rolls 3 and 4 and slender roll 5 preferably have their relative locations already corresponding to those in the nominal winding position. Then, when the apparatus is caused to its nominal winding position (e.g. by moving rolls 3 and 4 and slender roll 5 towards winding roll 2 the location of which may be fixed, or by moving winding roll 2 towards slender roll 5 and rolls 3 and 4 the location of which may be fixed), web I will be accordingly threaded up.

In the embodiments of FIGS. 6*a* and 6*b*, the apparatus preferably still have means for positioning automatically slender roll 5 between rolls 3 and 4 in the nominal winding position. Further, in case winding roll 2 is movable, it is preferably winding roll 2 which moves during winding in the nominal winding position, in order to adapt to the diameter of winding roll 2.

In the embodiments described in relation with FIGS. 1 to 5, web 1 passes between roll 3 and slender roll 5 and then between slender roll 5 and winding roll 2, when the apparatus is in the nominal winding position. Further, rolls 3 and 4 and slender roll 5 are movable from the open position to the nominal winding position, the location of winding roll 2 being fixed. There are alternate possibilities to define the rolls the location of which is fixed or movable in order to allow an easy thread up. For instance, it is possible to have the location of roll 4 and slender roll 5 being fixed (however, the apparatus preferably still has means for positioning automatically slender roll 5 between rolls 3 and 4 in said nominal winding position) and roll 3 and winding roll 2 movable in order to get into the nominal winding position. Then, it is preferably winding roll 2 which moves during winding in the nominal winding position, in order to adapt to the diameter of winding roll 2.

It is to be understood that in the described embodiments of the invention, the three roll system comprising rolls 3 and 4 and slender roll 5 for winding web 1 on winding roll 2 may be used independently from the jaw formed by rolls 6, 7, 8 and 9.

The invention is also well suited for an arrangement of the rolls 3, 4 and 5 in a substantially horizontal (e.g. +/−10°, especially +/−5°, preferably exactly horizontal) plane, corresponding to some existing production lines.

Figure 7:
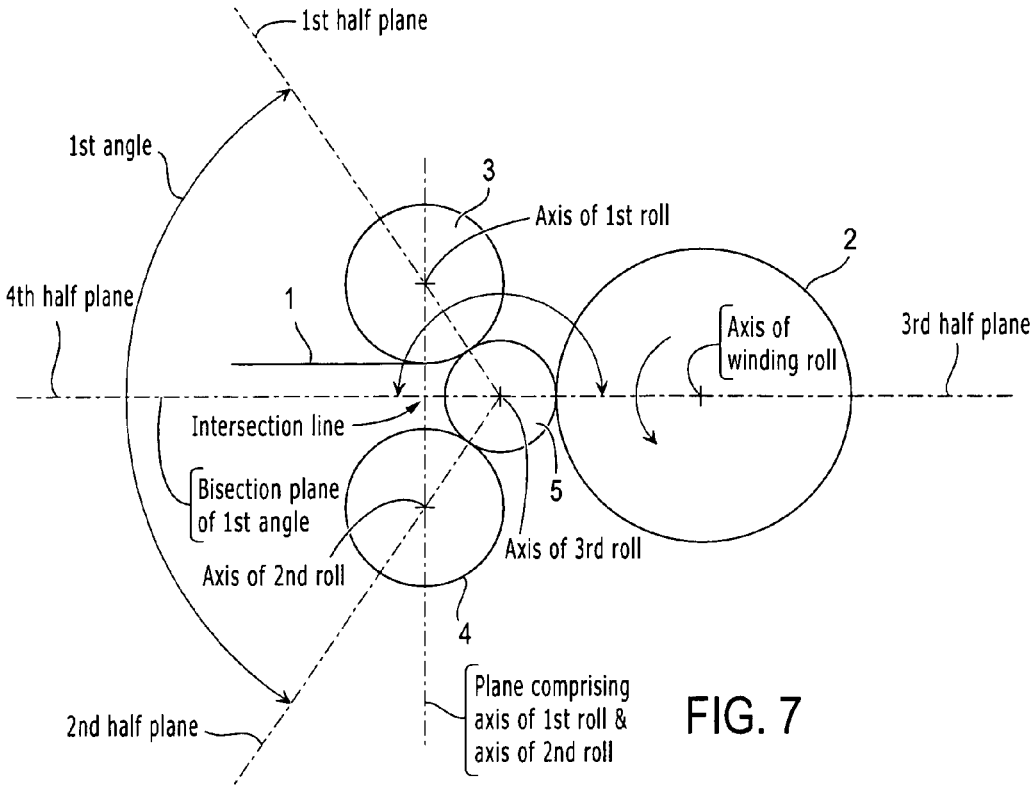
FIG. 7 is a schematic view for another embodiment of the invention.

FIG. 7 discloses an horizontal rolls arrangement. The film passes between rolls 3 and 5, then between rolls 5 and 2, the arrow indicating the rotation of winding roll 2. In the case represented, the first roll (3) is the upper roll while the second roll (4) is the lower roll. This planar arrangement is well suited for wide lines, typically 5 to 15 m wide, especially 7 to 11 m wide. In such a case, the diameter of roll 5 can be varied, to be for example 150–300 mm, preferably 200–280 nm, while the diameter of rolls 3 and 4 can be for example 300–900 mm, preferably 420–500 mm. The constitutive materials can be the same as previously disclosed. Rolls 4 and 5 can be of any type, including double-cylinders constrained rolls. The rolls can also be segmented or made of separated rolls.

Figure 8:
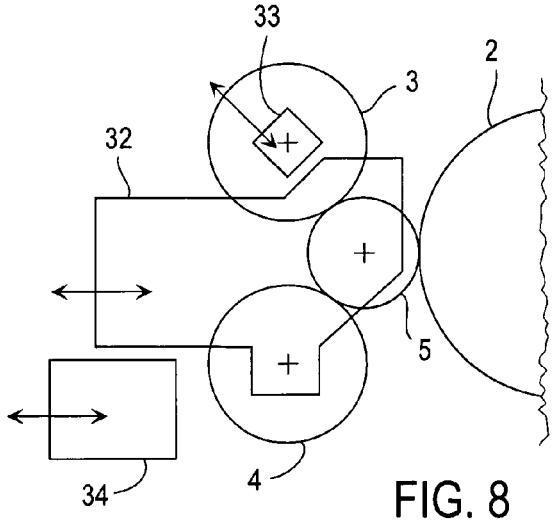
FIG. 8 is a further schematic view of the embodiment of FIG. 7.

In case of the horizontal arrangement, the rolls 3,4 and 5 can be arranged according to the embodiment of *fig*.8. As represented in FIG. 8, there is one carriage 32 carrying rolls 4 and 5, while roll 3 is mounted on a separate carriage 33, preferably slidably mounted on carriage 32. Carriage 32 is itself slidably mounted on carriage 34. Carriage 34 is the machine carriage, which is retracted as the diameter of the winding roll 2 increases. The arrows indicate the displacement of each carriage.

Figure 9:
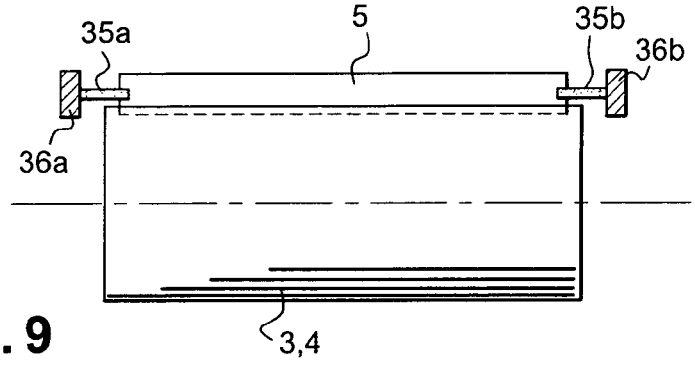
FIG. 9 is a top view of the embodiment of FIG. 7.

FIG. 9 is a top view of the above embodiment. Roll 5 is equipped with end-axles or shafts 35*a* and 35*b*, which are themselves mounted on sliding tables. 36*a* and 36*b*. The sliding tables comprise each two sliding rails, perpendicular to each other. Thus, each of the axles 35 and 35*b* is able to move freely in the two dimensions, since the sliding table is an idle sliding table. The table is linked with carriage 32. This allows, when roll 5 abuts on winding roll 2, to have a uniform contact with rolls 3, 4 and 2 by auto-centering of the roll 5 with respect to rolls 3, 4 and 2.

Figure 10:
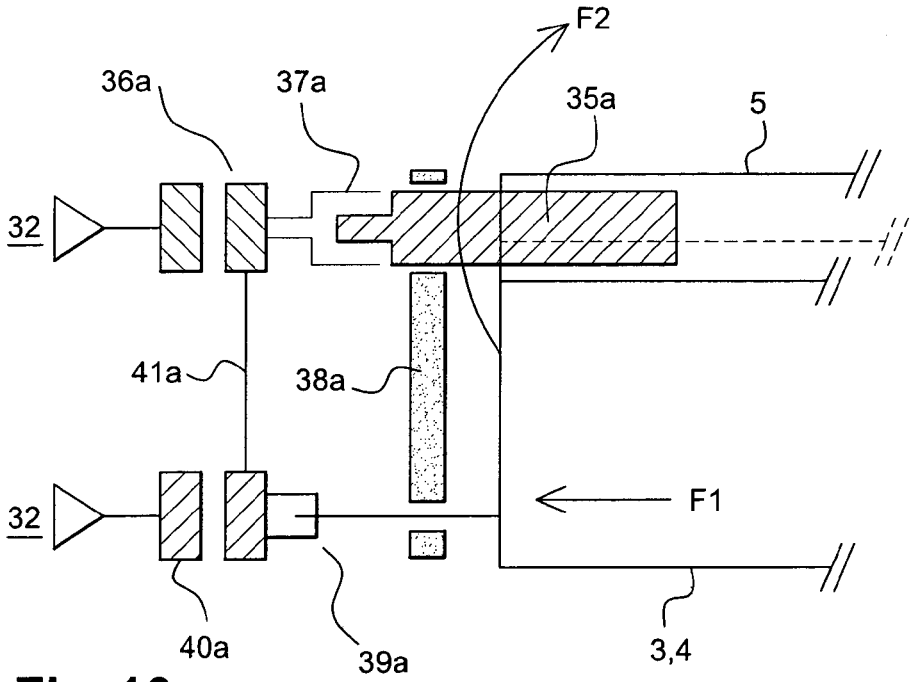
FIG. 10 is an enlarged side view of the embodiment of FIG. 7.
Figure 11:
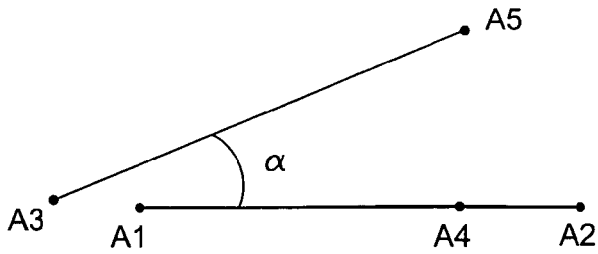
FIG. 11 shows the displacement possibilities of one roll according to the embodiment of FIG. 7.

FIG. 10 is an enlarged side view of the above embodiment. The shaft 35*a* extends first into roll 5 for a sufficient length, e.g. between 1 and 3 times the diameter of roll 5. Shaft 35*a* and roll 5 are connected through (rolling) bearings (not shown). Shaft 35*a* is connected at its other extremity to the sliding table 36*a*. Sliding table is schematically represented by two elements, one being secured to carriage 32 and the other representing the sliding element. The connection between shaft 35*a* and sliding table 36*a* is done through a ball-joint 37*a*. This ball-joint allows to ensure a full angular freedom between the table and the shaft, so as to guarantee the self-aligning function of roll (5) with respect to rolls (3), (4) and (2). Shaft 35*a* is connected to a lever 38*a*. The aim of the lever is to apply a bending moment to shaft 35*a* and consequently to roll 5. The lever is connected at its other extremity to a displacing piston 39*a*. The displacing piston 39*a*, preferably a pressure cylinder, displaces one extremity of the lever 28*a* according to arrow F1. In turn, the lever will exert a bending moment on the shaft 35*a* and consequently roll 5, represented by arrow F2. Displacing piston 39*a* is also further connected to a sliding rail 40*a*, which can freely move along a line (which is substantially horizontal as the third half-plane). Sliding table 36*a* and sliding rail 40*a* are connected by an articulated bar 41*a*. The displacement possibilities are schematically represented *fig.* 11, where A1 and A2 represent the initial positions of the piston 39*a* and ball-joint 37*a*, A3 and A4 after a translation and A3 and A5 after a further rotation. Thus, the free movement of roll 5 to auto-center between rolls 3, 4 and 2 is not impaired by the bending mechanism comprised of lever 38*a* and piston 39*a*, which simply follows roll 5 displacement.

The same arrangement is also available for the other shaft 35*b*; both arrangements are actuated in a parallel way, or according to distinct procedures, if required.

It should be noted that this embodiment can be applied to any system, not necessarily in an horizontal arrangement. It can notably be adapted to the system depicted in FIGS. 1–6.

Figure 12:
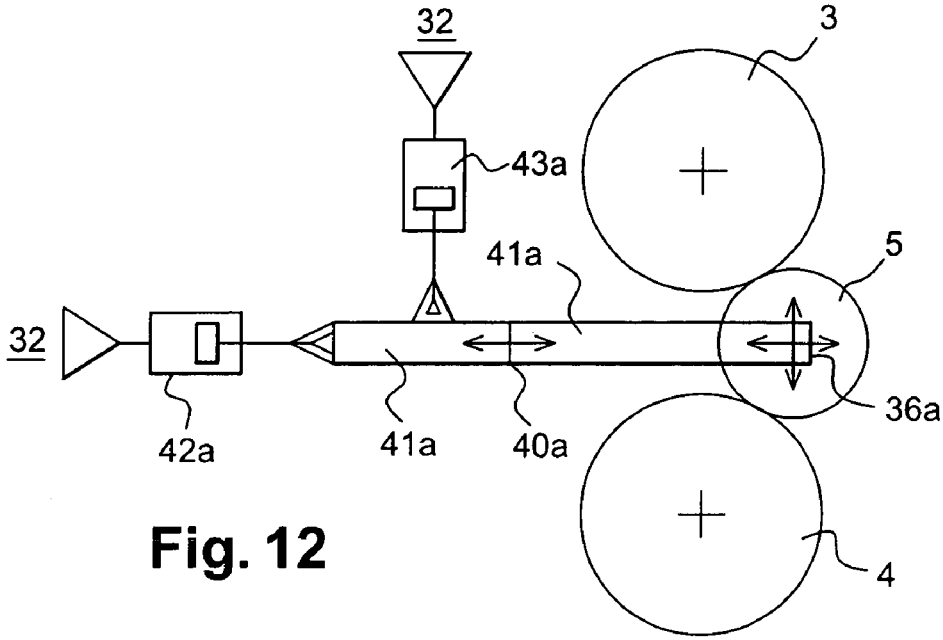
FIG. 12 is a further schematic view of the embodiment of FIG. 7.

FIG. 12 represents a further embodiment, in which the roll is equipped with a system similar to the system disclosed above with respect to the cylinders 19 and 25. In the instant case, cylinders 42*a* and 43*a* are fixed on carriage 32. These cylinders allow to apply horizontal and vertical forces on the extremities of roll 5.

In nominal winding position, cylinders 39*a,b* and 42*a,b* may apply respectively bending moments and forces in the horizontal plane, preferably both together in order to bring roll 5 in intimate and uniform contact with rolls 3 and 4 over their entire length. Rolls 3 and 4 may indeed have a non-straight bending line, to which roll 5 has to conform.

In roll change configuration, it is useful too that cylinders 39*a,b* and 42*a,b* apply bending moments and forces in the horizontal plane. As a matter of fact, during this step, roll 5 is turning at its nominal speed, which is quite high, but will not be abutting winding roll 2. In such a case, there is a risk of vibration that could be detrimental to the overall stability and hence to film quality. When binding moments and horizontal forces are applied, roll 5 is forced towards rolls 3 and 4, over its entire length, thus reducing drastically the vibrations.

In thread up mode, when roll 3 is in the retracted position, cylinders 43*a,b* may exert a vertical force to press roll 5 in contact with rolls 4 and 2.

FIG. 13 represents one possible thread up procedure.

Figure 13A:
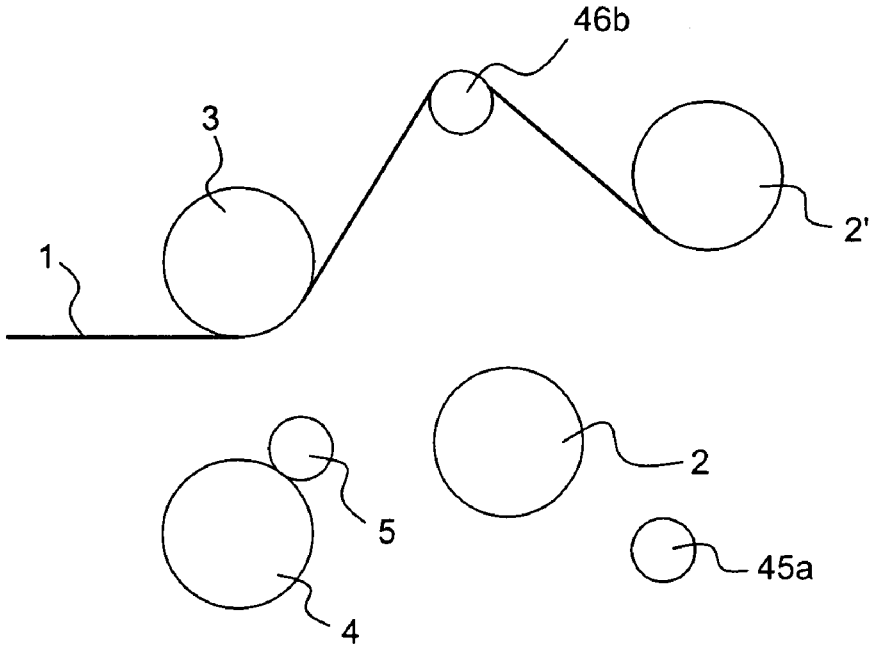
FIG. 13 represents one possible thread up procedure for the embodiment of FIG. 7.

Step 1 (FIG. 13*a*). The web 1 passes between roll 3 and rolls 4 and 5, carriage 33 carrying roll 3 being in upper position. The web is next rolled on core 2', passing first on an auxiliary roll 46*b*. A turret comprises cores 2 and 2', and auxiliary rolls 45*a* and 46*b*. This allows manual thread up by the upper side of the turret.

Step. 2 (FIG. 13*b*). Carriage 34 is moved closed to roll 2, so that rolls 4, 5 and 2 are in contact. At that time, the line speed can be, e.g., 150 m/min.

Step 3 (FIG. 13*c*). Carriage 33 is lowered to have roll 3 in contact with roll 5. At that time, the line speed can be increased.

Step 4 (FIG. 13*d*). Carriage 32 is moved back from core 2 and the turret is rotated by 360° counter-clock wise.

Step 5 (FIG. 13*e*). Carriage 32 is moved again towards roll 2; a cutting mechanism (not shown) is actuated in a classical manner to cut the web and cause it to be wound on core 2.

It would also possible to have the following sequence: step 1; step 4, step 2, step 3 or step 1; step 4, step 3, step 2.

FIG. 14 represents one possible roll change procedure.

Figure 14A:
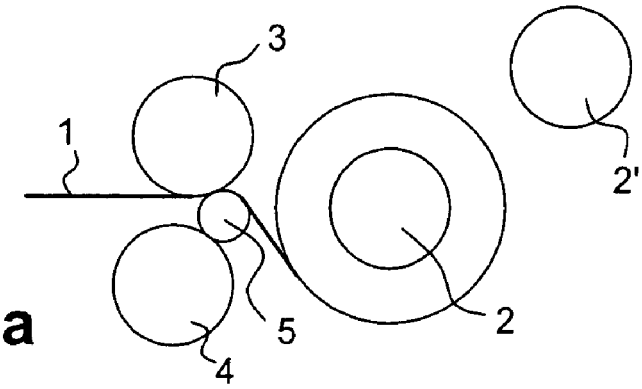
FIG. 14 represents one possible roll change procedure for the embodiment of FIG. 7.

Step 1 (FIG. 14*a*). Carriage 32 is moved back from wound roll 2.

Figure 14B:
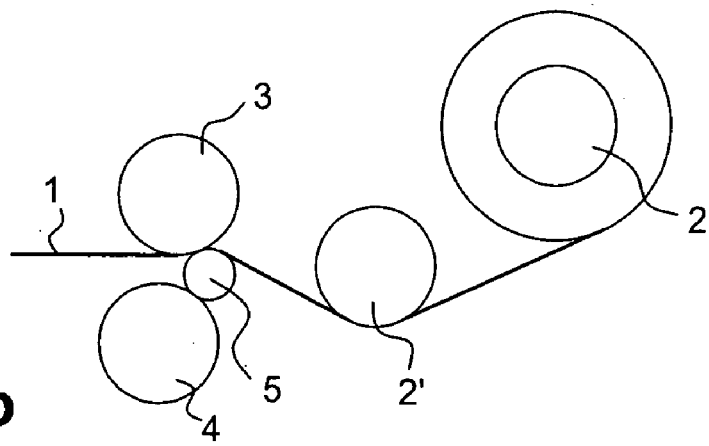

Step 2 (FIG. 14*b*). The turret is rotated 180° counter-clock wise.

Figure 14C:
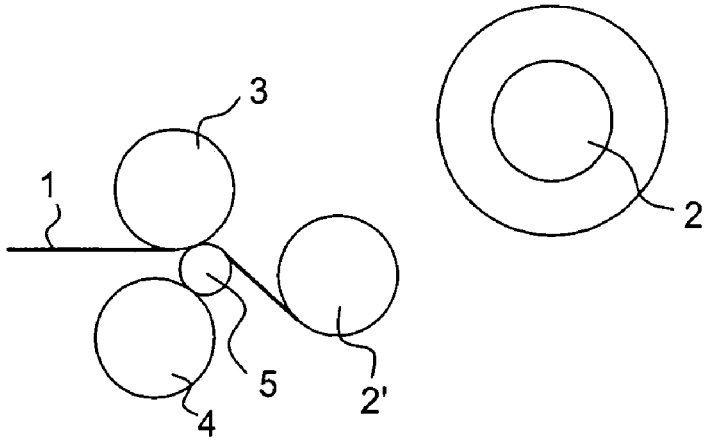

Step 3 (FIG. 14*c*). Carriage 32 is moved again towards core 2'; a cutting mechanism (not shown) is actuated in a classical manner to cut the web and cause it to be wound on core 2'.

In still another embodiment, a driving torque is applied to at least one of the rolls 3, 4 and 5, under the nominal state, so as to prevent shear forces acting on the film where the later is nipped. This embodiment is distinct from the one disclosed above with respect to FIGS. 1*a*, 1*b* or 1*c* (in which the rolls are caused to rotate for the purposes of a start procedure in order to void any tearing of the web). This allows to overcome rolling friction.

Figure 15:
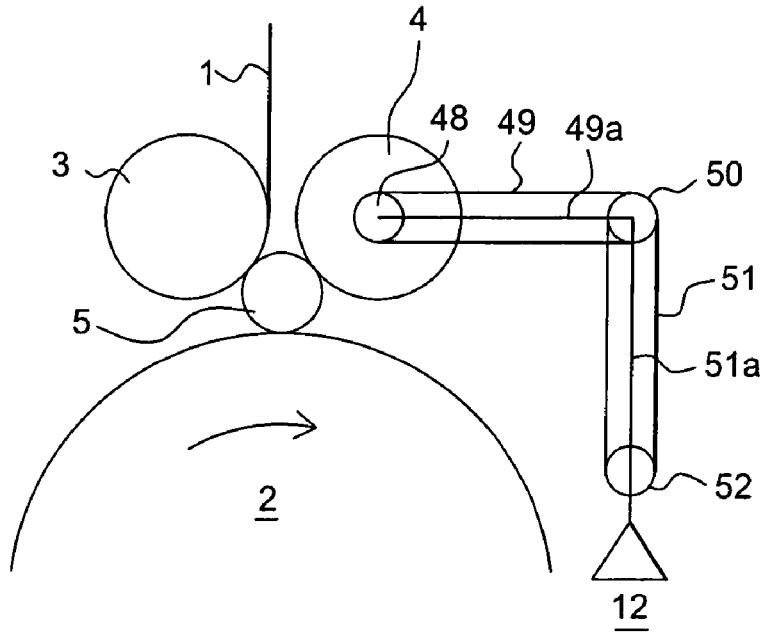
FIG. 15 represents another embodiment of the invention.

FIG. 15 discloses such an embodiment. The system is here a "vertical" system. Web 1 passes between rolls 3 and 5. Roll 4 (the roll not in direct contact with the web) is coupled to a pulley 48, driven by driving belt 49. Belt 49 is itself driven by pulley 50, itself again driven by belt 51. Belt 51 is driven by pulley 52, connected to the shaft of a motor (not shown), itself fixed on carriage 12. Two articulated levers 49*a* and 51*a* support pulley 50 and allow to tighten the belts. More precisely, lever 49*a* has one end articulated to roll 4 and the other one to lever 51*a*. The later is further articulated at the same location as the center of pulley 52. This system follows roll 4 displacement without significantly increasing its inertia mass. The inertial mass remains thus constant.

Further, in case the diameters of both pulleys 48 and 50 are identical, there will be no influence of the possible vertical displacement of roll 4 (due to e.g. roll 2 run out) on the rotational speed of roll 4.

This rolling friction-reducing apparatus can be adapted to any of the above-disclosed devices (vertical or horizontal).

Figure 16:
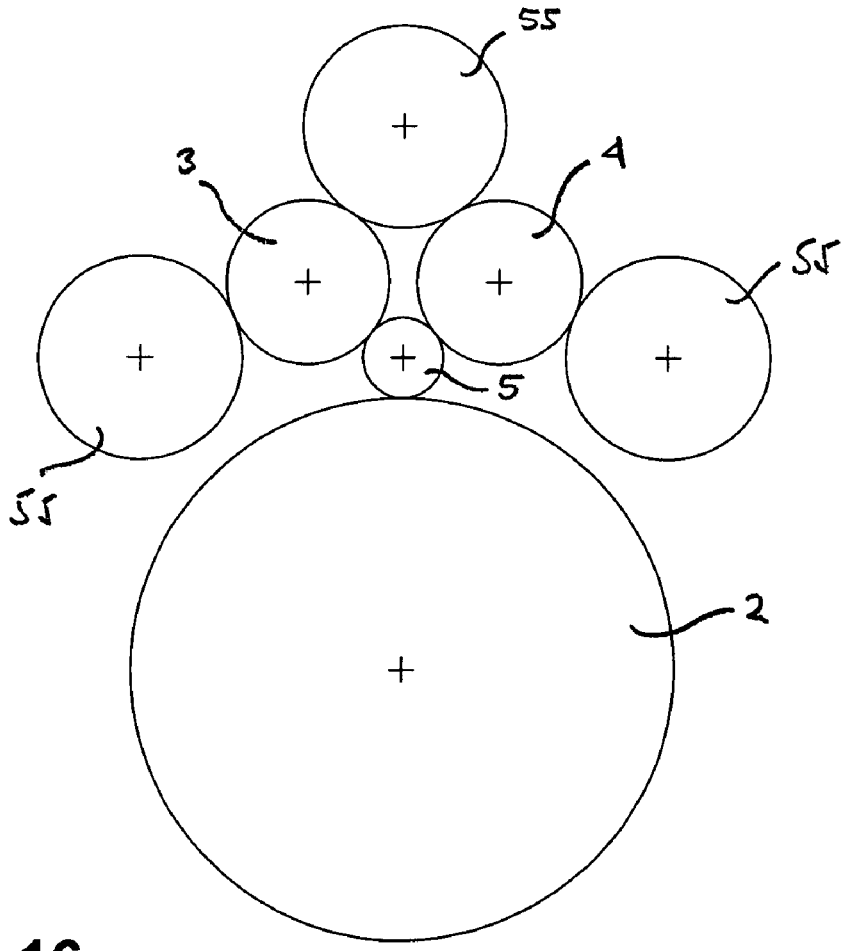
FIG. 16 represents still another embodiment of the invention.

Various modifications can be brought to the instant invention without departing from its spirit. For example, it is possible to have additional rolls 55 in contact with rolls 3 and 4. This is shown in FIG. 16. In fact any multiple rolls arrangement can be applied.

Of course, the invention is not limited to the embodiments described above.

The invention claimed is:

1. An apparatus for winding at least one web on a winding roll, comprising at least a first roll, a second roll and a third roll parallel to one another and to said winding roll, said winding roll and said first, second and third rolls each having an axis and said apparatus having a nominal winding position in which:

said first and second rolls and said winding roll are each in contact with said third roll;

there is no contact between said first roll and said second roll, between said first roll and said winding roll and between said second roll and said winding roll;

a first angle defined between a first half-plane delimited by the axis of said third roll and comprising the axis of said first roll and a second half-plane delimited by the axis of said third roll and comprising the axis of said second roll is smaller than 180°;

a second angle defined between a third half-plane delimited by the axis of said third roll and comprising the axis of said winding roll and a fourth half-plane delimited by the axis of said third roll and comprising an intersection line is greater than 90°, said intersection line being defined as the intersection between the bisector plane of said first angle and the plane comprising the axis of said first roll and the axis of said second roll;

wherein, in said nominal winding position, said at least one of said first, second and third rolls has driving means comprising a belt and pulleys system and a driving torque is applied to at least one of said first, second and third rolls as to rotate in the direction of said web in order to compensate for the rolling resistance of said apparatus, and wherein said first, second and third rolls are free to move along a direction not perpendicular to said third half-plane.

2. The apparatus according to claim 1, wherein in said nominal winding position, said third roll auto-centers with respect to said winding, first and second rolls.

3. The apparatus according to claim 1 wherein said system comprises a first pulley on said at least one driven roll, said first pulley being connected via a belt to a second pulley said second pulley being connected via another belt to a third pulley, said third pulley being driven by a motor.

4. The apparatus according to claim 1, wherein:

said web passes between said first and third rolls and then between said third roll and said winding roll, but not between said second roll and said third roll, and at least one of said second roll and first roll is driven and said third roll is caused to run along the circumference of said second roll or first roll whereby said second roll or first roll causes said third roll to rotate by friction driving in the direction and at a tangential speed corresponding substantially to those of said web.

5. The apparatus according to claim 1, wherein said third half-plane is substantially vertical.

6. The apparatus according to claim 1, wherein said third half-plane is substantially horizontal.

7. An apparatus for winding at least one web on a winding roll, comprising at least a first roll, a second roll and a third roll parallel to one another and to said winding roll, said winding roll and said first, second and third rolls each having an axis and said apparatus having a nominal winding position in which:

said first and second rolls and said winding roll are each in contact with said third roll;

there is no contact between said first roll and said second roll, between said first roll and said winding roll and between said second roll and said winding roll;

a first angle defined between a first half-plane delimited by the axis of said third roll and comprising the axis of said first roll and a second half-plane delimited by the axis of said third roll and comprising the axis of said second roll is smaller than 180°;

a second angle defined between a third half-plane delimited by the axis of said third roll and comprising the axis of said winding roll and a fourth half-plane delimited by the axis of said third roll and comprising an intersection line is greater than 90°, said intersection line being defined as the intersection between the bisector plane of said first angle and the plane comprising the axis of said first roil and the axis of said second roll;

wherein, in said nominal winding position, said at least one of said first, second and third rolls has driving means comprising a belt and pulleys system and a driving torque is applied to at least one of said first, second and third rolls as to rotate in the direction of said web in order to compensate for the rolling resistance of said apparatus, and wherein said first, second and third rolls are free to move along a direction substantially parallel to said third half-plane.

8. The apparatus according to claim 7 wherein said system comprises a first pulley on said at least one driven roll, said first pulley being connected via a belt to a second pulley said second pulley being connected via another belt to a third pulley, said third pulley being driven by a motor.

9. The apparatus according to claim 7, wherein:

said web passes between said first and third rolls and then between said third roll and said winding roll, but not between said second roll and said third roll, and at least one of said second roll and first roll is driven and said third roll is caused to run along the circumference of said second roll or first roll whereby said second roll or first roll causes said third roll to rotate by friction driving in the direction and at a tangential speed corresponding substantially to those of said web.

10. The apparatus according to claim 7, wherein said third half-plane is substantially vertical.

11. The apparatus according to claim 7, wherein said third half-plane is substantially horizontal.

12. An apparatus for winding at least one web on a winding roll, comprising at least a first roll, a second roil and a third roll parallel to one another and to said winding roll, said winding roll and said first, second and third rolls having each an axis and said apparatus having a nominal winding position in which:

said first and second rolls and said winding roll are each in contact with said third roll;

there is no contact between said first roll and said second roll, between said first roll and said winding roll and between said second roll and said winding roll;

a first angle defined between a first half-plane delimited by the axis of said third roll and comprising the axis of said first roll and a second half-plane delimited by the axis of said third roll and comprising the axis of said second roll is smaller than 180°;

a second angle defined between a third half-plane delimited by the axis of said third roll and comprising the axis of said winding roll and a fourth half-plane delimited by the axis of said third roll and comprising an intersection line is greater than 90°, said intersection line being defined as the intersection between the bisector plane of said first angle and the plane comprising the axis of said first roll and the axis of said second roll, wherein, in said nominal winding position;

a driving torque is applied to at least one of said first, second and third rolls so as to rotate in the direction of said web in order to compensate for the rolling resistance of said apparatus;

said at least one of said first, second and third rolls has driving means comprising a belt and pulleys system, said system comprising a first pulley on said at least one driven roll, said first pulley being connected via a belt to a second pulley, said second pulley being connected via a belt to a third pulley, said third pulley being driven by a motor; and said first and second pulleys are joined by a first lever and said second and third pulleys are joined by a second lever, said first and second levers being articulated at said second pulley, whereby said second pulley can move freely with respect to said first and third pulleys.

13. The apparatus according to claim 12, wherein said first lever is substantially perpendicular to a common direction along which said first, second and third rolls are free to move.

14. The apparatus according to claim 12, wherein said first lever is substantially perpendicular to said third half-plane.

15. The apparatus according to claim 12, wherein said second lever is substantially perpendicular to said first lever.

16. The apparatus according to claim 12, wherein said first and second pulleys have the same diameter.

17. The apparatus according to claim 12, wherein a total mass of said first lever, said pulleys and said belt is less than 10% of a mass of said at least one driven roll.

18. The apparatus according to claim 12, wherein the motor of said system is stationary.

19. The apparatus according to claim 12 wherein:

said web passes between said first and third rolls and then between said third roll and said winding roll, but not between said second roll and said third roll, and wherein at least one of said second roll and first roll is driven and said third roll is caused to run along the circumference of said second roll or first roll whereby said second roll or first roll causes said third roll to rotate by friction driving in the direction and at a tangential speed corresponding substantially to those of said web.

20. The apparatus according to claim 19, wherein only said second roll is driven.

21. The apparatus according to claim 19, wherein both said first and second rolls are driven.

22. The apparatus according to claim 12 wherein said third half-plane is substantially vertical.

23. The apparatus according to claim 12 wherein said third half-plane is substantially horizontal.

* * * * *